United States Patent [19]

Backes

[11] 4,135,025

[45] Jan. 16, 1979

[54] FABRIC WEB FOR PRODUCTION OF REINFORCING INSERTS FOR GARMENTS

[75] Inventor: Herbert Backes, Munich, Germany

[73] Assignee: Kufner Textilwerke KG, Munich, Germany

[21] Appl. No.: 764,172

[22] Filed: Jan. 31, 1977

[30] Foreign Application Priority Data

Feb. 2, 1976 [DE] Fed. Rep. of Germany ..... 2603855

[51] Int. Cl.[2] ..... B32B 3/00

[52] U.S. Cl. ..... 428/195; 2/272; 139/407; 139/408; 428/196; 428/246; 428/257; 428/262

[58] Field of Search ..... 139/407, 408, 383 R; 2/243 A, 243 B, 272; 428/195, 198, 257, 262, 196, 246

[56] References Cited

U.S. PATENT DOCUMENTS 2,356,456 8/1944 Garner ..... 139/397

3,991,246 11/1976 Schneider ..... 428/195

*Primary Examiner*—James J. Bell

[57] ABSTRACT

A fabric web intended for the production of garment inserts for reinforcing shoulder, chest or lap parts of garments the web having a reinforced region comprising a double-cloth formed by two fabrics, each having a warp thread and a weft thread system, and a reinforcing thread warp or weft system between the two fabrics, the reinforcing threads having a stronger spring force than the warp and weft threads of the two fabrics. Threads of a fabric are interlaced with threads of the other fabric and/or reinforcing threads are interlaced with fabric threads. The physical characteristics of at least one system, e.g. spring force of the reinforcing threads or thread spacing or density, vary in a direction transverse to the length of the threads of such system to provide a spring force and resilience which varies across and/or along the web from the reinforced region toward another portion of the web.

22 Claims, 16 Drawing Figures

Fig.1
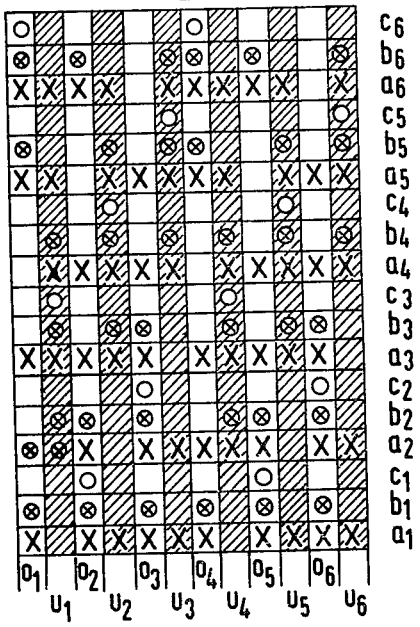
Fig.3
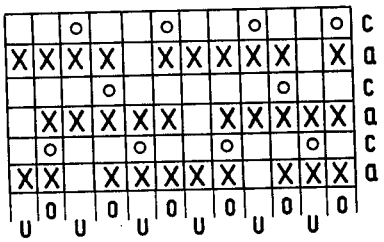
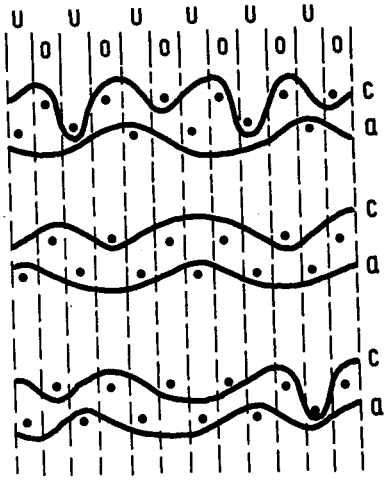
Fig.4
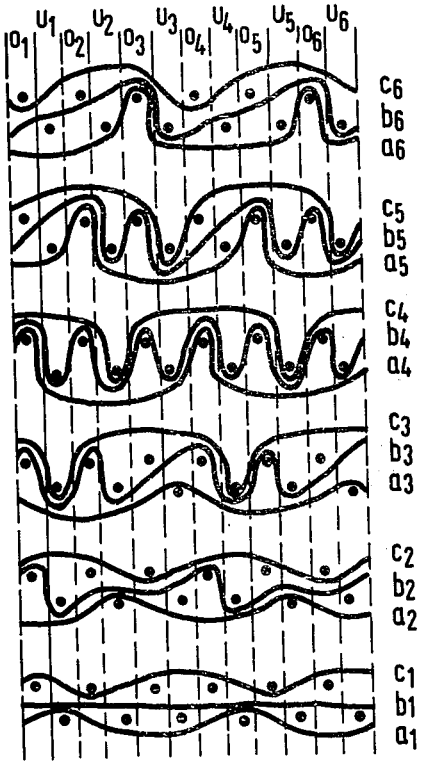
Fig. 2

Fig.5
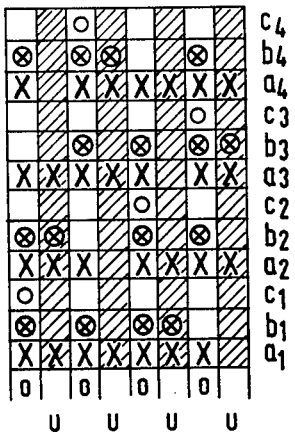
Fig.7
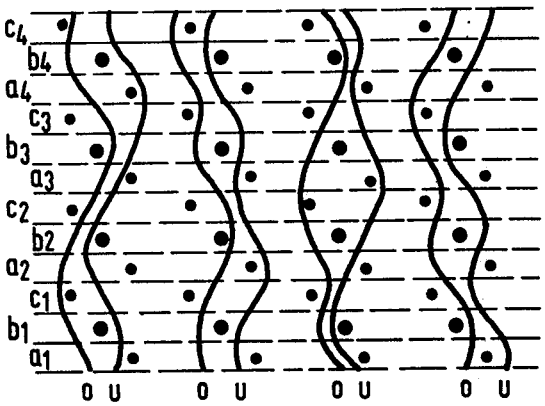
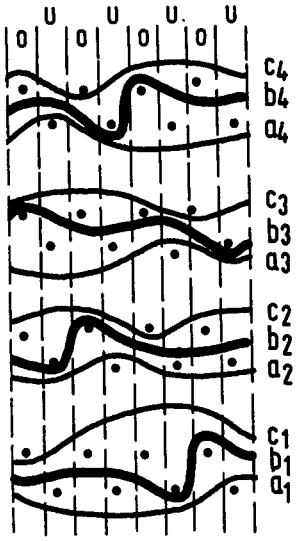
Fig.6

Fig. 8
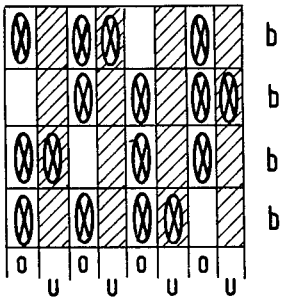
Fig.10
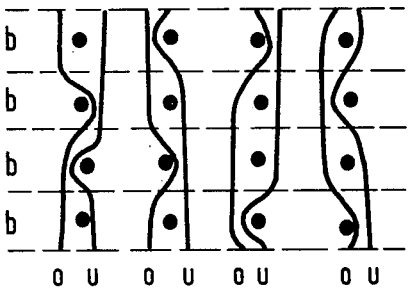
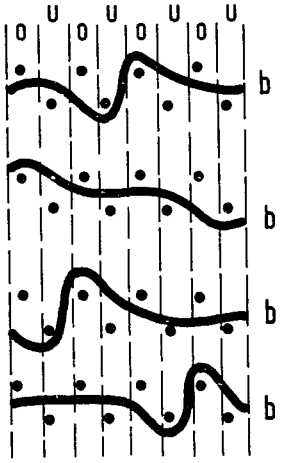
Fig.9
Fig.11
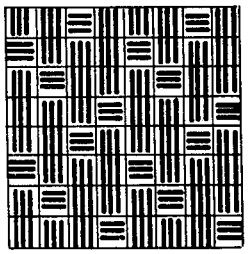

FABRIC WEB FOR PRODUCTION OF REINFORCING INSERTS FOR GARMENTS

The invention relates to a fabric web with adjacently disposed reinforcing regions of different resilience and spring force for the production of inserts cut therefrom for the shoulder, chest and lap reinforcement of garments, said inserts having the maximum resilience and spring force in the insert region intended for shoulder reinforcement and comprising a double fabric at least in this region.

Fabric webs for the production of inserts cut therefrom have already been proposed which comprise gradually springy reinforcement regions with maximum resilience and spring force in the insert region intended for shoulder reinforcement of garments, which reinforcement regions are adjacently disposed in the warp direction and contain in this region a double fabric comprising two fabric webs each having two warp thread and two web thread systems which are loosely and floatingly joined to each other through weft threads. In the reinforcement region comprising the double fabric the inserts cut therefrom have a volume which is substantially larger than that of the remaining regions with a single fabric so that passage of heat accompanying the ironing of the fixing inserts cut therefrom and coated with hot-sealing adhesive is obstructed to a much greater extent in the two-layer fabric region than in the remaining single-layer regions.

Abrupt changes of thickness occur at the line of transition from the single-layer to the double-layer fabric system, which leave impressions on the exterior of the garment in the course of ironing. Dressing and coating with hot-sealing adhesive also entail distortions and folds on either side of the transition line, which can become visible as additional impressions on the exterior of the material when the latter is ironed. Different shrinkage characteristics are also observed. The differences in heat passage result in different drying and sintering of the adhesive in the course of coating and in differences in adhesive action when the insert blanks are ironed. On the other hand, the better quality of textile feel compared with other inserts available on the market, which have graded reinforcement regions, cannot be denied so that there has been no lack of comprehensive approaches to develop reinforcing inserts with double-fabric regions to a stage suited for production and processing. The majority of the presently marketed kinds of inserts is unsatisfactory because they still require additional shoulder and chest padding by insertion of a traditional horse-hair canvas and a traditional shoulder support, and because they do not satisfy the requirement of the producers of ready-to-wear garments for a single insert which combines all the necessary reinforcing and padding functions.

The invention is based on the problem of providing a fabric web with reinforcement regions of different stiffness and comprising, at least in the most springy region of the web, a double fabric and is capable of being inserted as a sole insert into garments without additional inserts such as canvas or the like. Furthermore, the abovementioned disadvantages are to be substantially or completely avoided. According to the present invention this is accomplished in that a second warp thread or weft thread system is embedded between the two fabric inserts of the double fabric inserts of the double-fabric region, each comprising a warp thread and a weft thread system, the individual threads of the second system having a greater spring force than the warp or weft threads of the top and bottom fabric.

The second reinforcing thread system in the warp or weft direction can be embedded as a plain filling warp or a plain filling weft between the two fabric layers without interconnecting the two layers. In this case it is desirable for the warp or weft threads of the top and bottom fabric or weave to intermesh comparatively frequently so as to produce a connection bewteen the top and the bottom weave. Advantageously, however, the second reinforcing thread system interconnects the two fabric layers in the form of an interlacing warp or an interlacing weft by alternate engagement with the top and the bottom fabrics. It is also possible that several or all of the possible types of weave are combined in the reinforced double-fabric region of the inventive fabric web.

For better understanding various embodiments of the fabric web according to the present invention will be described in the following with reference to the accompanying drawings wherein:

FIG. 1 shows a weave pattern of one embodiment of the reinforced web region, comprising a double fabric and one supplementary reinforcing thread system disposed between the top and bottom fabrics of such double fabric, which is composed of warp threads, more particularly for the shoulder region of stiffening inserts;

FIG. 2 is a cross-sectional view, parallel to the weft threads, through the fabric illustrated in FIG. 1;

FIG. 3 shows the weave pattern of an embodiment of the fabric web with a double fabric without a supplementary reinforcing thread system, which is particularly suited for the chest region of stiffening inserts, which can adjoin the reinforced double fabric in the fabric web as illustrated in FIG. 1 and FIG. 2;

FIG. 4 is a cross-sectional view parallel to the weft threads, through the web region illustrated in FIG. 3;

FIG. 5 shows the weave pattern of another embodiment of a reinforced web region which is suited substantially for the shoulder region of inserts and comprises a double fabric with a supplementary reinforcing thread system disposed between the face cloth and the back cloth of said double fabric and comprising warp or weft threads;

FIG. 6 is a cross-sectional view through the fabric illustrated in FIG. 5 in the warp direction;

FIG. 7 is a cross-sectional view through the fabric illustrated in FIG. 5 in the weft direction;

FIG. 8 shows the weave pattern of one embodiment of a fabric region in warp or weft double weave, which is especially suited for the weft region of stiffening inserts and comprises the weave as illustrated in FIGS. 5 through 7 by the omission of the warp or weft threads of the face cloth and back cloth;

FIG. 9 is a cross-sectional view through the fabric illustrated in FIG. 8, as seen in the direction of the threads b;

FIG. 10 is a cross-sectional view through the fabric illustrated in FIG. 8, as seen in the direction of the threads o and u;

FIG. 11 is a plan view of one embodiment of the inventive fabric web in a region with cross-weft twill or cross-warp twill weave;

Figure 12:
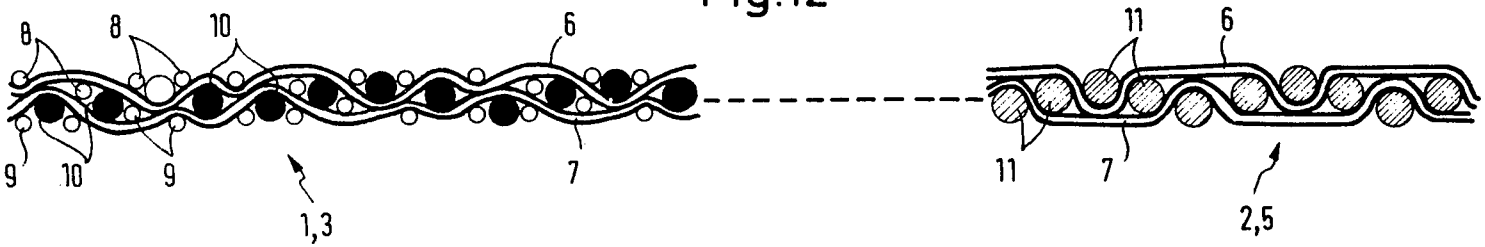
FIG. 12 is the cross-sectional view through one embodiment of the fabric web according to the present invention, which comprises, in the left half of the Figure, a reinforced double fabric for the shoulder region as illustrated in FIGS. 5 through 7, and, on the right-hand part of the Figure, a fabric as illustrated in FIGS. 8 through 10, intended substantially for the lap region.

All features explained in the description are of significance for the invention. Therefore they are also claimed for the invention even if they are not stated in the attached claims.

A corresponding, reinforced double fabric zone is illustrated in FIGS. 1 and 2. In this illustration the crossing points of all warp and weft threads of a weave pattern repeat are marked. The pattern repeat which adjoins horizontally or perpendicularly has the same weave pattern. The portions $a_1$ through $a_6$, $b_1$ through $b_6$, and $c_1$ through $c_6$, which are situated in the horizontal rows, are symbols of the weft threads whilst the portions $o_1$ through $o_6$ and $u_1$ through $u_6$, which are situated in the vertical rows, are symbols of the warp threads. The portions of the horizontal rows, which are designated with numeral a, represent the weft threads of the back cloth or fabric (= back weft) whilst those designated with numeral b refer to the weft threads of the embedded filling (packing) or binding weft, and those designated with numeral c represent the weft threads of the facing cloth (= facing weft). In the vertical rows the hatched portions designated by numerals $u_1$ through $u_6$ are the warps of the back cloth (= back weft) and the non-hatched portions designated by numerals $o_1$ through $o_6$ are the warps of the facing cloth (= facing warp). In several ones of the portions markings are entered. The marking symbols within the rows a, b or c correspond to each other. Each portion marking hence refers to a point of intersection of warp and weft threads, however with the proviso that at this point the associated warp thread bears on top of the associated weft thread. The points of intersection of back wefts with warp threads on top are situated in the horizontal rows $a_1$ through $a_6$ and are marked there in the portions by the numeral X. The numeral O denotes points of intersection of face wefts with warp threads on top, whilst the symbol ⊗ denotes points of intersection of packing or binding wefts with superimposing warp threads. The particular warp thread is placed on top is defined by the coordination to the vertical rows $o_1$ through $o_6$ and $u_1$ through $u_6$. Finally, the empty portions without markings indicate that at these points the respective weft thread is situated at the top and covers a warp thread placed underneath. The particular warp thread covered by a particular weft thread is in turn defined by the association with the horizontal and vertical rows, but in this case of the free portions.

For example, the marked and unmarked zones of the bottom horizontal row $a_1$ in FIGS. 1 and 2 have the following significance from left to right:

$o_1$ bears on $a_1$; $u_1$ is positioned underneath $a_1$; $o_2$ bears on $a_1$;

$u_2$ bears on $a_1$; $o_3$ bears on $a_1$; $u_3$ bears on $a_1$;

$u_4$ is positioned underneath $a_1$; $o_5$ is disposed on top of $a_1$;

$u_5$ bears on $a_1$; $o_6$ bears on $a_1$; and $u_6$ bears on $a_1$.

From the weave patterns of FIGS. 1 and 2 the cross-sectional patterns with the schematic sketch of the weft threads can be easily obtained to produce a plastic image. The cross-sectional views, too, are designated by numerals $a_1$–$a_6$, $b_1$–$b_6$, $c_1$–$c_6$ and $u_1$–$u_6$ and $o_1$–$o_6$. The extension of the reinforcing weft $b_1$ shows that the said weft thread is simply an inner packing weft which engages neither with the warp threads of the face cloth nor those of the back cloth and hence does not perform any binding function. On the other hand all reinforcing weft threads $b_2$ through $b_6$ engage with the face cloth and back cloth where they alternately surround face and back warp threads. These reinforcing weft threads connect the face cloth to the back cloth. A sole connection between face and back cloth by a reinforcing weft thread is accomplished by the binding weft thread $b_2$ which binds one of the three face and back weft threads. The remaining fabric cross-sectional views illustrate that also weft threads of the face and/or back cloth engage with the warp threads of the back and/or face cloth, so that an additional binding between face and back cloth is achieved. A particularly intimate binding can be seen in the cross-sectional illustration $a_4b_4c_4$ where face cloth and back cloth intermesh and where the reinforcing binding weft interlaces all warp threads of the face cloth and back cloth.

The weave pattern illustrated in FIGS. 1 and 2 shows a reinforced double cloth region with twill interlacing with visible twill line on both surfaces.

The insert web which is provided with this reinforced double cloth weave can preferably be materialized as a so-called weft variation such that the regions with the reinforced double cloth weave are repeated in the warp direction. These repeated reinforced regions are thereby produced by a variation of the weft threads whilst the warp threads remain unchanged over the entire length of the web.

Figure 16:
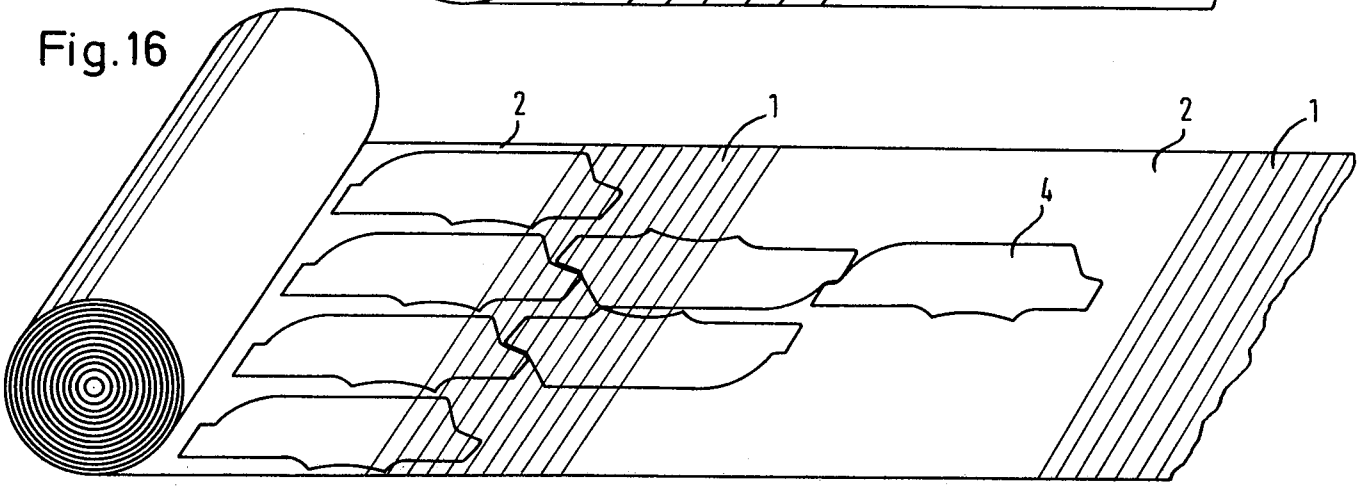
FIG. 16 shows one embodiment of the fabric web with a weft variation, partly rolled up, also with the insert blanks represented in the drawing.

The insert blanks 4 are cut out in the longitudinal direction from the above-mentioned fabric web, as is illustrated in FIG. 16. Substantial transverse regions 2 of reduced spring force are situated along the longitudinal extension of the fabric web between the repeating transverse reinforced double-cloth regions 1.

The fabric stiffness should vary continuously if possible. To this end the transverse zones of the reinforced double-double cloth region 1 is followed by a transition region where the springy intermediate reinforcing weft threads are successively replaced by weft threads having less spring force. This can be followed by a plain double-cloth region comprising two warp thread systems and two weft thread systems respectively, and then by a single-ply fabric with one warp thread and one weft thread system, e.g. a fabric in the known cross-twill weave. In this case it is advantageous to provide for thickness equalization at the transition by the employment of a more voluminous weft thread system in the cross-twill fabric region.

The single-ply double-cloth region adjoining the reinforced double-cloth region can have a weave, for example, such as that sketched in FIGS. 3 and 4.

Sequences other than the above-mentioned weave sequence can also be selected. For example, a direct transition from the double-cloth transition region with less springy intermediate weft to the cross-twill weave is possible, and in this case, too, thickness equalization can be accomplished by using a more voluminous weft thread system in the cross-twill region. Finally, it is also possible to dispense entirely with a change of weave and to provide the double-cloth region with an additional weft thread which has a graded spring force and extends over all reinforcement stages.

A single-ply fabric with cross-twill weave in the intermediate regions can also be substituted by a double-warp weave comprising two warp thread systems and one weft thread system.

It is also possible to select simpler kinds of weave which comprise a double cloth with embedded reinforcement threads instead of the comparatively complicated double-cloth weave with reinforcement weft threads as illustrated in FIGS. 1 and 2. The reinforcement threads can be weft threads as well as warp threads, and finally it is possible to achieve transitions to the less springy regions of the insert web by means of these simpler weaves, which transitions elegantly rise and fall entirely smoothly and homogenously and which in terms of the weave can be derived directly from each other by addition or omission of thread systems.

Such insert web comprises, for example, in the reinforced double-cloth region the weave pattern of a weave pattern repeat as illustrated in FIG. 5. In the weave pattern which is constantly repeated horizontally and vertically in the fabric, the horizontal rows designated by numerals a, b, or c represent again face wefts, back wefts and intermediate reinforcing wefts in the case of an insert web woven as a weft variation. The intermediate wefts are binding wefts which alternately interlace the face cloth and the back cloth. There is no additional interlacing between the face cloth and the back cloth. The vertical rows o and u are the face and back warps of the weft variation. The cross-sectional view shown in FIG. 6 illustrates the extension or the course of the weft threads a, b and c whilst in FIG. 7 the course of both warp threads o and u is illustrated.

The insert web, which cannot only be produced as a weft variation but also as a so-called warp variation, also has the weave pattern shown in FIG. 5, but in this case the horizontal rows a, b and c of the weave pattern are face, back and intermediate reinforcement weft threads while the vertical rows o and u are the face and back wefts of the warp variation. In this case the cross-sectional view of FIG. 6 illustrates the course of the warp threads a, b and c while the cross-sectional view of FIG. 7 illustrates the course of the two weft threads o and u.

In the warp configuration the weft threads remain unchanged over the entire length of the web and the grading of the reinforcement regions is accomplished transversely to the web by variation of the warp threads.

Figure 15:
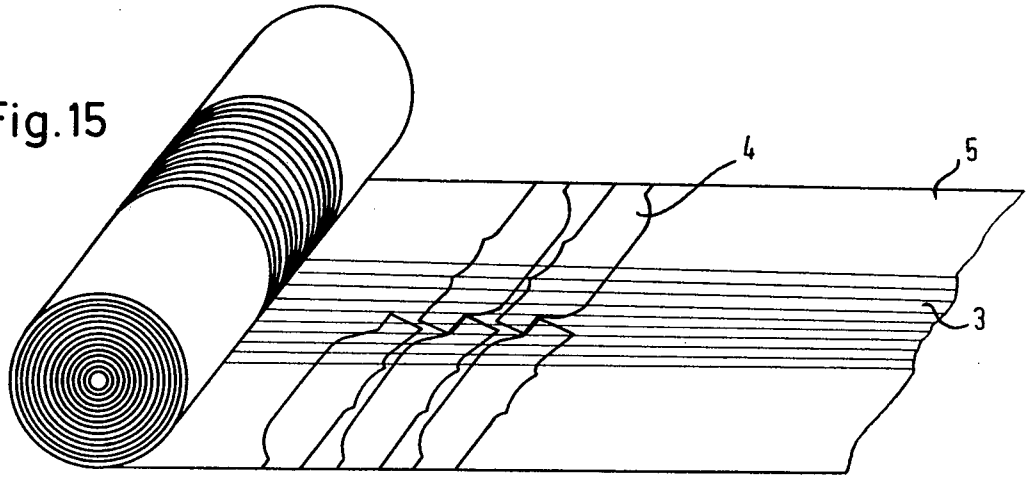
FIG. 15 shows one embodiment of the inventive fabric web with a warp variation, partly rolled up, in a perspective view with the insert blanks represented in the drawing.

FIG. 15 shows the arrangement of the reinforced double-cloth region 3 in the middle of the web. The less stiff fabric regions 5 are situated on both sides of the web, from which the inserts are cut out transversely to the web. This illustration shows a mirror-image fabric web from which two insert blanks 4 can be cut out in the transverse direction through a nesting and material-saving arrangement. This insert web can also be made avaiable to the processor in a width which allows only one insert to be obtained in the transverse direction. It is also possible to arrange the reinforced double-cloth regions 3 on the edges of the double-width web.

In the webs illustrated in FIGS. 15 and 16 according to FIGS. 5 to 7, the reinforced double-cloth regions 1, 3 are adjoined by transition regions derived from the fabric of said double-cloth regions, which in the case of a warp variation are adjoined by a warp doubling region and in the case of a weft variation by a weft doubling region which is intended for the least springy lap reinforcement in the cut-out insert. The associated weave pattern is illustrated in FIG. 8. The cross-sectional views in the longitudinal and transverse direction of FIGS. 9 and 10 show that the double weave of FIG. 8 is derived from the weave of FIG. 5 by omission of the thread systems a and c.

Figure 13:
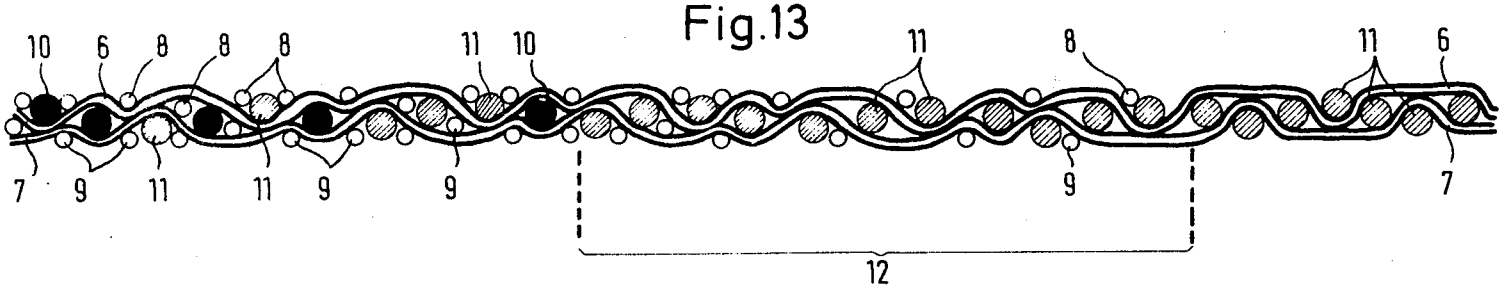
FIG. 13 shows one embodiment of the intermediate region, absent in FIG. 12 and intended substantially for the chest region, which is disposed between the reinforced double fabric as illustrated in FIGS. 5 through 7 and the double weave as illustrated in FIGS. 8 through 10.
Figure 14:
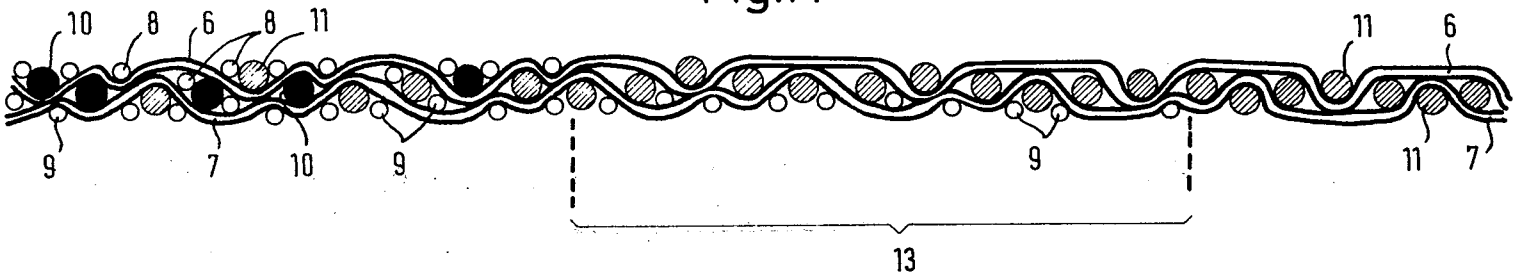
FIG. 14 illustrates another embodiment of such intermediate region which is absent in FIG. 12.

From the fabric cross-sectional views in FIGS. 12, 13 and 14, which approximately also illustrate the relative spacial arrangement of the thread systems, a three-dimensional view of all grad-ed regions is obtained.

In the example illustrated in FIG. 12 the fabric web comprises a reinforced double-cloth region 1, 3 with the same density of the warp or weft threads 8, 9, 10, 11 of the face, back and reinforcing warp thread systems or of the face and back reinforcing weft thread system. This region is adjoined by a transition region in which the density of the warp or weft threads 8, 9 of the face and/or warp or of the face and/or weft is reduced and where the springy reinforcing warp or weft threads 10 are replaced, initially partially and then in their entirety, by less springy reinforcing threads 11, followed by a further region 2, 5 without face and back warp or weft threads 8, 9 in weft or warp double weave. The weft or warp threads of the face and back cloth, which are transverse thereto and correspond to the threads o and u in FIGS. 1 through 10, are designated in the present illustration by numerals 6 and 7.

The warp or weft thread density of the face and back warp or of the face and back weft can be uniformly reduced on both sides of the fabric as is illustrated in region 12 in FIG. 13. In this case the warp or weft density of the face and back warp 8, 9 or of the face and back weft 8, 9 is always the same on opposite locations of the fabric. But it can also be asymmetrical and in an extreme case in such a way that on one side of the fabric the face warp or face weft threads 8 or the back warp or back weft threads 9 are removed either partially or wholly. FIG. 14 illustrates such a transition 13 to the double weave in which the face warp threads 8 in a warp variation or the face weft threads 9 in a weft variation are absent initially in part and then in their entirety. In the region with back warp or back weft threads 9 and the missing face warp or face weft threads 8 the corresponding fabric region is a double cloth comprising two fabric plies each having one warp and one weft thread system.

The illustrated weaves and weave transitions according to FIGS. 8 through 14 permit accomplishment of a particularly high degree of uniform fabric thickness by selecting suitably different yarn thicknesses in the reinforcing or binding thread system, which feature is of particular significance when the inventive insert web is woven as a warp variation because otherwise the weaving, dressing, coating and coiling into reels ready for shipment would be difficult or hardly feasible. The spring force between the reinforced double-cloth region for shoulder reinforcement and the non-reinforced springy double region for lap reinforcement can in practice vary continuously in the same fabric web in the region of very high resilience to the region of soft and woolly fabric characteristic of the fabric. To this end, yarns with large-gauge fibers are employed predominantly for the reinforced double-cloth region and in the adjoining less strong regions they are replaced, initially in part and then in their entirety, by yarns with less coarse or with fine fibers.

The fine fiber materials mainly comprise regenerated cellulose fibers with a fiber gauge of less than 6 dtex and preferably between 1.5 and 4.0 dtex, but also synthetic fibers, e.g. fluffy polyacrylonitrile fibers. The springy reinforcing threads can consist of yarns or twined yarns of coarse endless synthetic fibers. The twines can be produced by serving or doubling with fine cotton or cellulose threads. Preferably multi-fill yarns of regenerated cellulose or cellulose esters are employed as endless synthetic yarns, which comprise approximately 5 to 25 individual fibers with a fiber gauge of approximately 20 to 150 dtex. Also endless yarns of synthetic polymers, such as polyamide or polyester, can be used. Finally, the reinforcing threads can also comprise yarns or twines containing human or animal hair. In the latter case the yarns or twines should be protected against hair migration by treatment with a binding agent.

The face and back warp and weft threads of the reinforced double cloth region and the adjoining transition region generally consist of fiber material which is finer than the reinforcing threads of the reinforced double-cloth region. These threads can consist predominantly or exclusively of yarns or twines of cotton or regenerated cellulose. Whilst the fiber grade of cotton is determined by nature and ranges between 1.2 and 2.4 dtex the fiber grade of the regenerated cellulose fibers can be selected again from the above-mentioned range of below 6 dtex approximately, and preferably from the range from 1.5 to 4.0 dtex.

The weave pattern which is visible mainly on the fabric face and back sides should be preferably the weave pattern of a cross-twill weave in the reinforced double-cloth region. The weaves according to FIGS. 8 through 14 produce such a weaving pattern although they can also be replaced by weaves with a different weaving pattern. The cross twill weave of the face and back cloth and the double weave can be derived from the weave patterns and the fabric cross-sections, and in this context the warp and weft threads of the face cloth on the top of the double-cloth region and the warp and weft threads of the back cloth on the underside of the double-cloth region with an additional reinforcing warp thread system produce the weaving pattern of a warp cross-twill weave in which the warp threads float over several weft threads, for instance three weft threads according to FIGS. 5 to 7, and therebetween place the weft thread in a cruciform offset configuration beyond a point of intersection on the surface of the face or back side of the cloth. Accordingly, the weaving pattern of a weft cross-twill weave is produced by the warp and weft threads of the face cloth on the top side and by the warp and weft threads of the back cloth on the underside of the double-cloth region with additional reinforcing weft thread system, in a configuration in which the weft threads float over several warp threads, for instance three warp threads according to FIGS. 5 to 7, and therebetween place the warp thread in a cruciform offset configuration beyond a point of intersection on the surface of the face or back side of the cloth.

In the double region where the face and back cloth is missing, the cross-twill weave according to FIGS. 8 to 11, namely, the weft cross-twill weave on the top and the underside, also appears if the reinforced double-cloth region shows a warp cross-twill weave. In this case the double interlace is a weft double weave. Conversely the warp cross-twill weave appears in the double region on the top and the underside when the weft cross-twill weave appears in the reinforced double-cloth region. In this case the double weave is a warp double weave.

The embodiment of the inventive fabric web as shown in FIG. 12 can, for instance, be readily modified within the scope of the invention if the back warp or back weft threads on the left side in FIG. 12 are woven-in over the entire web surface and are not removed so as to produce a completely uniform weaving pattern on one fabric web side. Preferably this side of the fabric is used to apply the textile hot-sealing adhesive.

Finally, the fabric web can also be varied by a change of the weft and warp density from fabric region to fabric region and within the regions themselves.

When the weaving step is finished the inventive fabric web is processed as usual and is subjected to high-quality finishing and anti-shrink dressing. Dressing of the fabric web results neither in distortion nor folding.

The fabric web is intended mainly for so-called front fixing in which the insert blanks are joined to the outer cloth of garments such as jackets, costumes, coats, by ironing. To this end, the fabric web is provided with a continuous layer of a hot-sealing textile adhesive which is preferably applied in a dot-raster arrangement to one side of the fabric web.

The total insert length and the length ratio of its different reinforcement regions relative to each other depends on the garment into which the insert is to be placed. In the case of a jacket the average insert length is approximately 83 cm to 87 cm. In fabrics of the weft variation, approximately the same insert pattern repeat length should be provided in the longitudinal direction and in fabrics of the warp variation approximately the same or twice the fabric width should be provided. Compared with inserts for jackets the inserts for coats usually have a somewhat shortened chest part and a lengthened lap part, which is influenced by fashion and must therefore be woven in a suitably modified form.

Inserts of the fabric web according to the invention in their entirety provide very springy and resilient reinforcements in the shoulder and chest regions, however with a flowing texture without having a stiff board-like feel which is reduced elegantly and with a homogeneity not accomplished up to date from the shoulder region downward and which in the lap region has a bulky-soft characteristic which leads to optimum wearing comfort. Additional inserts such as canvas pads or shoulder pads can be omitted.

I claim:

1. Fabric web with a reinforced region in which the web has graduated, different resilience and spring force, for the production of garment inserts cut therefrom for reinforcement of shoulder, chest and lap parts of garments, in which fabric web, at least in the reinforced region, there is a double-cloth formed by two fabrics, each of the said two fabrics comprising one warp system of warp threads and one weft system of weft threads, characterized in that reinforcing threads in the form of a second warp or weft thread system are embedded between the two fabrics, said reinforcing threads having a stronger spring force than said warp and weft threads of the two fabrics of the said double-cloth, some of the threads of at least one of said fabrics or of said second system being interlaced with threads of at least the other of said fabrics and, at least a first portion of one of such systems within said region having physical characteristics which differ from the physical characteristics of a second portion of said one system, said characteristics varying in a direction transverse to the length direction of the threads of said one system to provide a spring force and resilience which varies from said first portion of said reinforced region toward another portion of said web.

2. Fabric web as claimed in claim 1, characterized in that said reinforcing threads are interlaced into at least one of said two fabrics of the double cloth.

3. Fabric web as claimed in claim 2, characterized in that said reinforcing threads are alternately interlaced into one of said fabrics and into the other of said fabrics of said double cloth.

4. Fabric web as claimed in claim 2, characterized in that said reinforcing threads are plain filling threads which are not interlaced between said two fabrics of said double cloth.

5. Fabric web as claimed in claim 4, characterized in that said warp or weft threads of at least one of said two fabrics of said double cloth are interlaced into the other fabric of said double cloth.

6. Fabric web as claimed in claim 1, characterized in that outside said reinforced web region formed by said double cloth with embedded reinforcing threads, a less stiff region is provided which comprises a double cloth formed by one of two systems, a system comprising two warp thread systems combined with one weft thread system and a system comprising two weft thread systems combined with one warp thread system.

7. Fabric web as claimed in claim 6, characterized in that between said reinforced region with said double cloth and embedded reinforcing threads and said less stiff region, a transition region is provided in which the threads of one of said warp and said weft systems of the two fabrics of said double cloth have a density which is less in relation to that of the corresponding threads of said reinforced web region comprising the said reinforcing threads.

8. Fabric web as claimed in claim 7, characterized in that said threads of said one of said warp and said weft systems are provided only in one of the said two fabrics of the double cloth in said transition region.

9. Fabric web as claimed in claim 6, characterized in that said reinforcing threads provided between said two fabrics of the said double cloth have different degrees of stiffness.

10. Fabric web as claimed in claim 9, characterized in that said reinforcing threads embedded between said two fabrics of the said double cloth decrease in stiffness from said reinforced web region toward said less stiff region, whereby in the region of transition to a less stiff web region decreasingly stiff reinforcing threads are present to an increasing extent.

11. Fabric web as claimed in claim 6, characterized in that a double cloth with reinforcing warp thread system is followed by a weft doubling region which provides on the face and back sides of the web the weave pattern of a weft cross-twill weave.

12. Fabric web as claimed in claim 6, characterized in that a double cloth with reinforcing weft thread system is followed by a warp doubling region which provides on the face and back sides the weave pattern of a warp cross-twill weave.

13. A fabric web as claimed in claim 1, characterized in that the region formed by said double-cloth with reinforcing threads is followed by a single weft and single warp cross-twill region.

14. Fabric web as claimed in claim 1, characterized in that said reinforcing threads are warp threads and said warp and weft threads of said two fabrics of the said double cloth are woven so that the warp and weft threads of the face cloth on the top and the said warp and weft threads of the back cloth on the bottom of the said double cloth have the weave pattern of a warp cross-twill weave.

15. Fabric web as claimed in claim 1, characterized in that said reinforcing threads are weft threads and said warp and weft threads of said two fabrics of the said double cloth are woven so that the warp and weft threads of the face cloth on the top and the warp and weft threads of the back cloth on the bottom side of the said double cloth have the weave pattern of a weft cross-twill weave.

16. Fabric web as claimed in claim 1, characterized in that the said reinforcing threads are only multi-fill threads of regenerated cellulose with a fiber gauge of between 20 to 15 dtex.

17. Fabric web as claimed in claim 1, characterized in that it contains cotton fibers.

18. Fabric web as claimed in claim 1, characterized in that it contains regenerated cellulose fibers with a fiber gauge of less than 6 dtex and preferably between 1.5 and 4 dtex.

19. Fabric web as claimed in claim 1, characterized in that it is provided on one side with spaced areas of a textile hot-sealing adhesive, preferably in the form of spaced dots of said adhesive.

20. Fabric web as claimed in claim 1 wherein said one system is the reinforcing thread system and said reinforcing threads in said first portion have a spring force different from the spring force of the reinforcing threads in said second portion.

21. Fabric web as claimed in claim 1 wherein said one system is the reinforcing thread system and the spacing of said reinforcing threads in said first portion is different from the spacing of the reinforcing threads in said second portion.

22. Fabric web as claimed in claim 1 wherein said one system is a system of one of said fabrics and the density of the threads of said last-mentioned system in said first portion is different from the density of the threads of said last-mentioned system in said second portion.

* * * * *